US008382533B2

(12) United States Patent
Pavlovic et al.

(10) Patent No.: US 8,382,533 B2
(45) Date of Patent: Feb. 26, 2013

(54) ELECTRICALLY CONDUCTING TERMINAL

(75) Inventors: Slobodan Pavlovic, Novi, MI (US); David Menzies, Linden, MI (US); Cecil Lamar Brown, II, Canton, MI (US); Michael Glick, Farmington Hills, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 13/080,982

(22) Filed: Apr. 6, 2011

(65) Prior Publication Data

US 2012/0003883 A1 Jan. 5, 2012

Related U.S. Application Data

(60) Provisional application No. 61/364,916, filed on Jul. 16, 2010, provisional application No. 61/360,938, filed on Jul. 2, 2010.

(51) Int. Cl.
*H01R 13/33* (2006.01)

(52) U.S. Cl. ..... 439/840; 240/275

(58) Field of Classification Search ..... 439/840, 439/841, 844, 851, 852, 380, 909; 200/275
See application file for complete search history.

(56) References Cited

U.S. PATENT DOCUMENTS

| | | | | |
|---|---|---|---|---|
| 2,914,344 | A * | 11/1959 | Anthes | 285/93 |
| 3,278,890 | A | 10/1966 | Cooney | |
| 3,382,479 | A * | 5/1968 | Cooney | 439/840 |
| 4,093,337 | A * | 6/1978 | Jacobson | 439/840 |
| 4,857,015 | A * | 8/1989 | Michaels et al. | 439/607.47 |
| 4,934,366 | A * | 6/1990 | Truex et al. | 607/37 |
| 5,076,270 | A * | 12/1991 | Stutz, Jr. | 607/37 |
| 5,139,276 | A | 8/1992 | Balsells | |
| 5,226,682 | A * | 7/1993 | Marrison et al. | 285/308 |
| 5,358,224 | A | 10/1994 | Balsells | |
| 5,474,309 | A | 12/1995 | Balsells | |
| 5,599,027 | A | 2/1997 | Balsells | |
| 5,697,804 | A * | 12/1997 | Froberg et al. | 439/346 |
| 5,727,821 | A * | 3/1998 | Miller | 285/318 |
| 6,336,832 | B2 * | 1/2002 | Nobe | 439/857 |
| 6,425,443 | B1 * | 7/2002 | Hill et al. | 166/377 |
| 6,835,084 | B2 | 12/2004 | Poon et al. | |
| 7,035,689 | B1 * | 4/2006 | Hawkins et al. | 607/37 |
| 7,110,827 | B2 * | 9/2006 | Sage et al. | 607/116 |
| 7,294,020 | B2 * | 11/2007 | Zhao et al. | 439/627 |
| 2003/0221837 | A1 * | 12/2003 | Giroux et al. | 166/373 |
| 2004/0245686 | A1 | 12/2004 | Balsells | |
| 2005/0242910 | A1 | 11/2005 | Balsells | |
| 2008/0041477 | A1 * | 2/2008 | Shotter et al. | 137/876 |
| 2008/0246231 | A1 | 10/2008 | Sjostedt et al. | |

(Continued)

FOREIGN PATENT DOCUMENTS

| | | | |
|---|---|---|---|
| DE | 4325289 | A1 | 4/1995 |
| DE | 69403172 | T2 | 1/1998 |

(Continued)

OTHER PUBLICATIONS

German Office Action for corresponding Application No. 10 2011 078 412.8, mailed Nov. 16, 2012, 8 pages.

*Primary Examiner* — Edwin A. Leon
*Assistant Examiner* — Harshad Patel
(74) *Attorney, Agent, or Firm* — Brooks Kushman P.C.

(57) ABSTRACT

An electrical terminal having at least one open end that is configured to receive a connector in an electrically conducting manner. The open end portion of the connector may be configured with differently sized and/or shaped portions to facilitate receipt of connector, such as to receive the connector in a manner that limits misalignment and/or receipt of bent or crooked connectors.

11 Claims, 2 Drawing Sheets

U.S. PATENT DOCUMENTS

| | | | |
|---|---|---|---|
| 2008/0254670 | A1 | 10/2008 | Balsells et al. |
| 2008/0255631 | A1 | 10/2008 | Sjostedt et al. |
| 2009/0048638 | A1 | 2/2009 | Rey et al. |
| 2009/0258519 | A1 | 10/2009 | Dilmaghanian et al. |
| 2010/0029127 | A1 | 2/2010 | Sjostedt |
| 2010/0029145 | A1 | 2/2010 | Balsells et al. |
| 2010/0279558 | A1 | 11/2010 | Leon et al. |

FOREIGN PATENT DOCUMENTS

| | | | |
|---|---|---|---|
| DE | 19836196 | A1 | 2/1999 |
| DE | 102004002404 | B3 | 9/2005 |
| FR | 2301931 | | 9/1976 |

* cited by examiner

ELECTRICALLY CONDUCTING TERMINAL

CROSS-REFERENCE TO RELATED APPLICATIONS

This application claims the benefit of U.S. provisional Application No. 61/360,938 filed Jul. 2, 2011 and U.S. provisional Application No. 61/364,916 filed Jul. 16, 2010, the disclosures of which are incorporated in their entirety by reference herein.

TECHNICAL FIELD

The present invention relates to electrical terminals, such as but not limited to terminals of the type having coil springs operable to facilitate electrical connectivity between the terminal and one or more electrical connectors.

BACKGROUND

Electrical terminals are used in a number of applications to facilitate electrical connections between one element and another. Some electrical terminals may be configured to facilitate use with a removable connector of the type that may be repeatedly inserted and removed from electrical engagement with the electrical terminal. The ability of the electrical terminal to facilitate electrical connectivity with such a removable connector can be problematic if an electrical connection area between the terminal and connector has poor connectivity, particularly when tolerance variations or degradation from repeated use causes a mating arrangement between the components to become loose or otherwise insecure.

U.S. patent application Ser. Nos. 13/070,576 and 13/073,478, the disclosures of which are incorporated in their entirety by reference herein, propose solutions to the problematic issues associated with poor connectivity with the use of an element to provide an interference fit between the terminal and the connector through which connectivity may be improved. U.S. patent application Ser. No. 13/080,753, the disclosure of which is incorporated in its entirety by reference herein, addresses problems associated with positioning of the element within the terminal. Another problematic issue relates to aligning the connector for receipt within the terminal as misalignment may damage the connector during insertion, weaken an interference fit between the terminal/element and connector, and/or chip away at a plating material used to facilitate connectivity, each of which negatively influences connectivity.

SUMMARY

One non-limiting aspect of the present invention relates to an electrical terminal configured to receive a connector comprising: an electrically conducting body; an open end interior to at least one end of the body; a first portion of the open end having a first diameter; a second portion of the open end having a second diameter; wherein the first diameter is a first amount greater than a connector diameter of the connector; wherein the second diameter is a second amount greater than the connector diameter; and wherein the first amount is greater than the second amount.

One non-limiting aspect of the present invention relates to a third portion of the open end having a third diameter greater than the second diameter.

One non-limiting aspect of the present invention relates to a fourth portion of the open end having a fourth diameter greater than the second diameter.

One non-limiting aspect of the present invention relates to the fourth diameter being greater than the first diameter.

One non-limiting aspect of the present invention relates to the fourth diameter being approximately equal to the first diameter.

One non-limiting aspect of the present invention relates to the fourth diameter being less than the third diameter and the third diameter is greater than the first diameter.

One non-limiting aspect of the present invention relates to a resilient element having an opening configured to receive the connector being positioned within the third portion.

One non-limiting aspect of the present invention relates to an inner diameter of the opening in the resilient element being less than the second diameter.

One non-limiting aspect of the present invention relates to the inner diameter of the opening in the resilient element being less than the connector diameter.

One non-limiting aspect of the present invention relates to the resilient element including a plurality of coils configured to define the inner diameter, where at least a portion of the plurality of coils configured to provide an interference fit when the connector is inserted within the open end.

One non-limiting aspect of the present invention relates to an electrical terminal configured to receive a connector having a connector diameter comprising: an electrically conducting body having an open end; a first portion of the open end having a first diameter greater than the connector diameter; a second portion of the open end having a second diameter different from the first diameter and greater than the connector diameter; and a resilient element within the open end having an inner opening configured to receive the connector, the inner opening having an inner diameter less than the connector diameter so as to facilitate electrical connectivity between the terminal and the connector through an interference fit.

One non-limiting aspect of the present invention relates to a third portion of the open end having a third diameter greater than the connector diameter.

One non-limiting aspect of the present invention relates to a fourth portion of the open end having a fourth diameter greater than the connector diameter.

One non-limiting aspect of the present invention relates to the first diameter being greater than the second diameter, the fourth diameter being greater than the first diameter, and the third diameter being greater than the fourth.

One non-limiting aspect of the present invention relates to the third portion being configured to receive the resilient element.

One non-limiting aspect of the present invention relates to an axial length of the second portion being less than an axial length of the fourth portion.

One non-limiting aspect of the present invention relates to an axial length of the first portion being greater than the axial length of the second portion and less than the axial length of the fourth portion.

One non-limiting aspect of the present invention relates to the resilient element being comprised of a plurality of coils arranged to delimit the inner opening.

One non-limiting aspect of the present invention relates to an axial length of the third portion being approximately equal to a diameter of the plurality of coils.

One non-limiting aspect of the present invention relates to an electrical terminal configured to receive a connector having a connector diameter comprising: an electrically conducting body having an open end; a first portion of the open end having a first diameter greater than the connector diameter and a first axial length; a second portion of the open end having a second diameter different from the first diameter and greater than the connector diameter and a second axial length less than the first axial length; a third portion of the open end having a third diameter greater than the connector diameter and a third axial length less than the second axial length; and a fourth portion of the open end having a fourth diameter greater than the connector diameter and a fourth axial length greater than the first axial length.

BRIEF DESCRIPTION OF THE DRAWINGS

The present invention is pointed out with particularity in the appended claims. However, other features of the present invention will become more apparent and the present invention will be best understood by referring to the following detailed description in conjunction with the accompany drawings in which:

DETAILED DESCRIPTION

Figure 1:
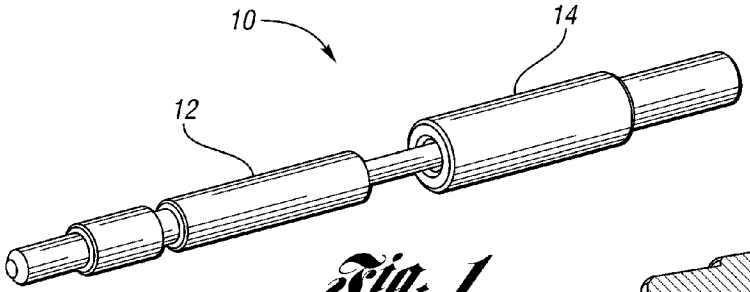
FIGS. 1-4 illustrate an electrical terminal in accordance with one non-limiting aspect of the present invention.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

FIGS. 1-4 illustrate an electrical terminal 10 in accordance with one non-limiting aspect of the present invention. The electrical terminal 10 may be configured in accordance with the present invention to facilitate electrically interconnecting a first connector 12 and a second connectors (not shown), such as but not limited to one being a high current terminal suitable for use in hybrid electric vehicle charge couplers, optionally conforming to the Society of Automotive Engineers (SAE) standard SAE J1772. The electrical terminal 10 may be comprised of a conducting material body 14 having integrally formed first and second ends configured to facilitate respectively establishing a removable electrical connection with the first connector and/or the second connector. The electrical terminal 10 may be formed through a machining operation or other suitable manufacturing process to include a first bored or open end 16 and a second bored or opened end 18.

The bored ends 16, 18 are shown to be cylindrically shaped to facilitate fitting with a corresponding shaped portion of the first connector and/or the second connector. The terminal 10 and bored ends 16, 18, however, are not intended to be limited to being cylindrically shaped and may be shaped into any other suitable geometry. The second end 18, optionally, may be formed with another connection feature instead of the illustrated bore, such as but not limited being formed as a solid and/or deformable material that may be welded, affixed, or otherwise connected to the connecting element, including being shaped as male terminal used for insertion into a mating female terminal. As such, the description herein sets forth the illustrated embodiment for exemplary purposes only and without intending to unnecessary limit the scope and contemplation of the present invention.

A conducting element 22 may be positioned within the first bored end 16 to facilitate electrical interconnection with the body portion 14. The conducting element 22 is shown to be a coil spring but may comprise any suitably sized and shaped conducting element 22 operable to facilitate establishing and/or enhancing the electrical interconnection between the body 14 and the first connector 12. Other such conducting elements may include a conducting elastomer having suspending micro-wires, braided element, etc. The exemplary coil spring 22 may be comprised of a plurality of coils arranged as shown into a tubular shape to delimit an inner diameter $C_i$ and an outer diameter $C_o$. The coil spring 22 may be comprised of any suitably conducting material and/or resilient material capable of flexing during connector insertion and thereafter unflexing when the connector is removed. The resiliency of the coil spring 22 may be beneficial in preventing tolerance variations or degradation from repeated use from causing the electrical connection between the body 14 and the first connector to become loose or otherwise insecure.

Figure 2:
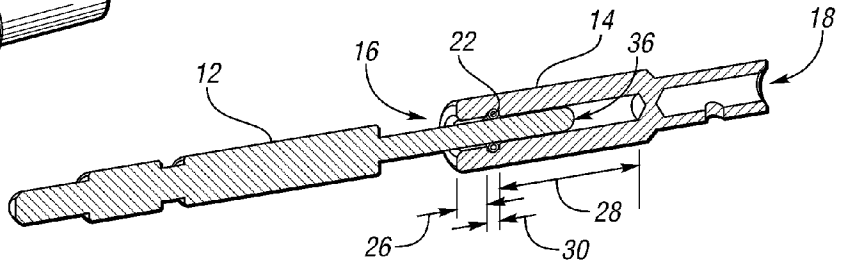
Figure 3:
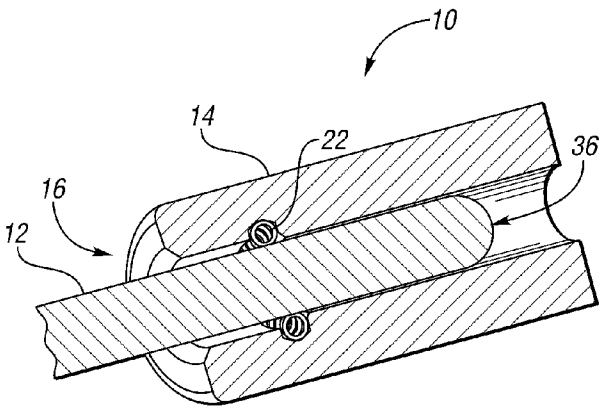
Figure 4:
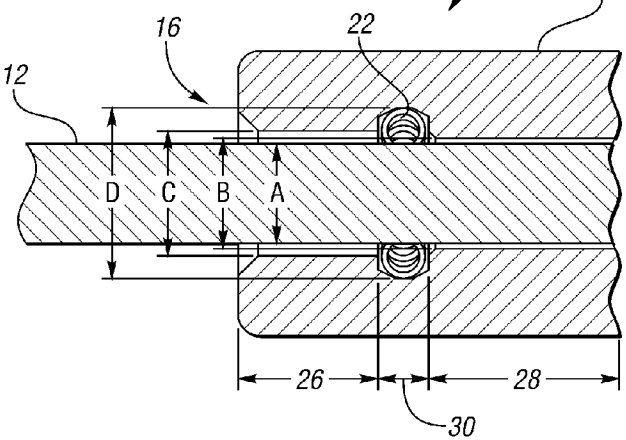

The cross-sectional views of FIGS. 2-4 illustrate the interior of the open end 16 having a first portion 26, a second portion 28, and a third portion 30 where each portion 26, 28, 30 is shown to have a first diameter C, a second diameter B, and a third diameter D. Each of these portions 26, 28, 30 may also be defined by a corresponding first axial length, second axial length, and third axial length. One non-limiting aspect of the present invention contemplates configuring the first, second, and third portions 26, 28, 30, such as through manipulation of the diameters B, C, D and/or axial lengths, to facilitate insertion of the connector 12 within the open end 16 in a manner that maximizes electrical connectivity and minimizes misalignment.

The first portion 26 may correspond with an entry end of the open end 16 where the connector 12 is first aligned with the terminal 10 for insertion. The second portion 28 may correspond with a supporting end of the open end 16 inboard of the third portion were clearance between the connector 12 and terminal 10 is the smallest in order to limit movement of the connector 12 and to maximize a wall thickness of the terminal 10. The third portion 30 corresponds with a groove between the first and second portions 26, 28 where the resilient element 22 is secured. One non-limiting aspect of the present invention contemplates a connector diameter A being 1.50 mm, the first diameter C being 1.93 mm, the second diameter B being 1.65 mm, and the third diameter D being 2.67 mm. These diameters, however, are provided for exemplary purposes and the present invention fully contemplates the terminal 10 being much larger or smaller.

The noted diameters A, B, C, D are provided to describe relative dimensions and ratios between the connector 12 and the terminal 10 in order to demonstrate various beneficial aspects of the present invention with respect to facilitating electrical connectivity and connector alignment. The first diameter C may be selected to be an amount larger than the second diameter B in order to provide a funnel type of entry so that the connector 12 need not be as precisely aligned with the narrower second diameter B when initially entering the open end 16. The amount by which the first diameter C is greater may also be selected based on the inner and outer diameters $C_i$, $C_o$ of the resilient element 22 in that the first diameter C may be selected to provide a diameter sufficiently sized to facilitate operation of a tool, fixture, or human hand in positioning the resilient element 22 within the third portion 30. The second diameter B may be selected to support the connector 12 once properly inserted in order the limit an amount by which the outboard end is laterally moveable.

The axial lengths of each of the first, second, and third portions 26, 28, 30 may also be selected to facilitate similar design requirements. The first axial length may be selected to position the resilient element 22 as far inboard as possible given insertion limitations of the insertion tool used to position the resilient element 22 so that more of the first portion 26 is available to facilitate aligning the connector 12 with the second portion 28 prior to the connector 12 coming into contact with the resilient element 22, which may help in preventing a leading point 36 of the connector 12 from contacting the resilient element 22. The axial length of the third portion 30 may be selected to corresponding with the diameters of a plurality of coils comprising the resilient element 22 so that a sufficient amount of lateral force is provided to hold the resilient at a desired position. The axil length of the second portion 28 may be selected to provide a desired amount of support for the inserted connector 12.

Figure 5A:
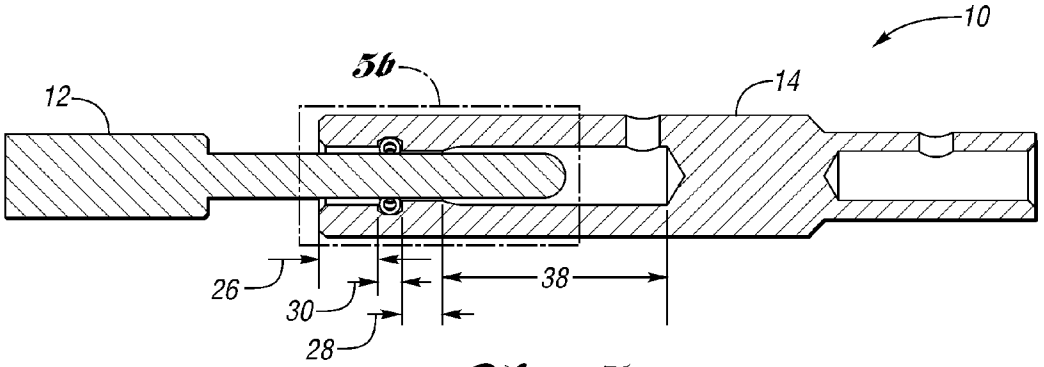
FIGS. 5*a*-5*b* illustrate the electrical terminal being adapted for use with bent connectors in accordance with one non-limiting aspect of the present invention.
Figure 5B:
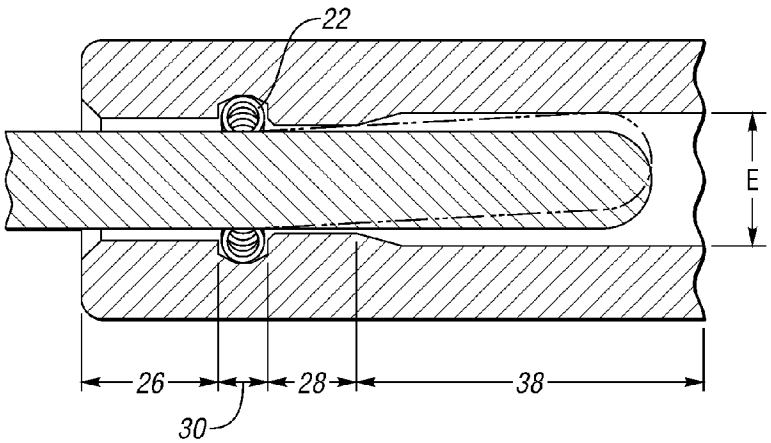

FIGS. 5*a*-5*b* illustrate an alternative configuration of the terminal 10 where the second axial length is abbreviated and replaced with a fourth portion 38 in accordance with one non-limiting aspect of the present invention. The fourth portion 38 may have a fourth diameter E and fourth axial length. The fourth diameter E, for exemplary and non-limiting purposes, is shown to be 2.00 mm. The fourth diameter E, being slightly greater than the first diameter C and the second diameter B, may be beneficial in allowing the terminal 10 to receive connectors having a bent leading end (shown in phantom) 36. This capability may be particularly beneficial where the terminal 10 is used to receive connectors that may be damaged, such as from repeated interaction with the terminal 10 and/or through some other activity.

Figure 6:
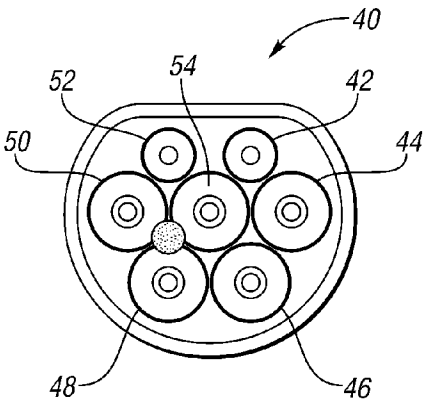
FIG. 6 illustrates a charging terminal of a plug-in charging system having a plurality of the electrical terminals in accordance with one non-limiting aspect of the present invention.

FIG. 6 illustrates a charging terminal 40 of a plug-in charging system used to facilitate charging a vehicle-mounted battery. U.S. patent application Ser. No. 13/078,164, filed Apr. 1, 2011, the disclosure of which is incorporated in its entirety by reference herein, describes the use of such a charging terminal 40. The charging terminal 40 may be configured with a plurality of the terminals 42, 44, 46, 48, 50, 52, 54 described above to facilitate mating interaction within a cordset (not shown) or other device having a corresponding plurality of connectors. The alignment of the cordset connector with the terminals 42, 44, 46, 48, 50, 52, 54 of the charging terminal may be facilitate with the advantageous benefits of the terminal described herein, at least in so far as the terminals 42, 44, 46, 48, 50, 52, 54 facilitating connectivity and alignment, and if necessary with connectors having a bent leading point.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. An electrical terminal configured to receive a connector having a connector diameter, the terminal comprising:

an electrically conducting body;

an open end interior to at least one end of the body;

a first portion of the open end adjacent to the at least one end of the body, the first portion having a first diameter and a first axial length;

a second portion of the open end spaced apart from the first portion, the second portion having a second diameter and a second axial length;

wherein the first diameter is a first amount greater than the connector diameter;

wherein the second diameter is a second amount greater than the connector diameter for precise alignment of the connector;

wherein the first amount is greater than the second amount for funnel type guiding of the connector prior to the precise alignment of the second diameter;

a third portion of the open end between the first portion and the second portion, the third portion having a third diameter and a third axial length, the third diameter being greater than the second diameter; and a resilient element within the third portion having an opening configured to provide an interference fit with the connector, the resilient element having a resilient element axial length.

2. The electrical terminal of claim 1 further comprising an aperture extending through a sidewall of the conducting body into the second portion to prevent pressure build-up during connector insertion.

3. The electrical terminal of claim 2 further comprising the second portion having a fourth portion of a fourth diameter greater than the second diameter for receipt of a bent connector, the fourth portion being spaced apart from the third portion, with the second portion between the third portion and the fourth portion.

4. The electrical terminal of claim 3 wherein the fourth diameter is greater than the first diameter.

5. The electrical terminal of claim 3 wherein the fourth diameter is approximately equal to the first diameter.

6. The electrical terminal of claim 3 wherein the fourth diameter is less than the third diameter and the third diameter is greater than the first diameter.

7. The electrical terminal of claim 2 wherein no more than the aperture is included inboard the first portion to provide a fluid passageway from the open end to an area exterior to the terminal.

8. The electrical terminal of claim 1 wherein an inner diameter of the opening in the resilient element is less than the second diameter.

9. The electrical terminal of claim 8 wherein the inner diameter of the opening in the resilient element is less than the connector diameter.

10. The electrical terminal of claim 9 wherein the resilient element includes a plurality of coils configured to define the inner diameter.

11. The electrical terminal of claim 1 wherein the first axial length, the second axial length, and the third axial length are at least equal to the resilient element axial length.

* * * * *